US006810885B2

(12) United States Patent
Montoli et al.

(10) Patent No.: US 6,810,885 B2
(45) Date of Patent: Nov. 2, 2004

(54) MASCARA BRUSH WITH HIGH DUROMETER FIBERS

(75) Inventors: Antonio Montoli, Brookfield, CT (US); Raymond P. LeGassie, Laconia, NH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 341 days.

(21) Appl. No.: 10/075,736

(22) Filed: Feb. 14, 2002

(65) Prior Publication Data

US 2003/0150075 A1 Aug. 14, 2003

(51) Int. Cl.[7] ..... A45D 40/26; A46B 3/18

(52) U.S. Cl. ..... 132/218; 132/320; 15/206; 15/207.2

(58) Field of Search ..... 15/206, 207.2; 132/218, 320

(56) References Cited

U.S. PATENT DOCUMENTS

| | | | | | |
|---|---|---|---|---|---|
| 4,660,582 | A | | 4/1987 | Taylor | 132/218 |
| 4,733,425 | A | | 3/1988 | Hartel et al. | 15/206 |
| 4,887,622 | A | | 12/1989 | Gueret | 132/320 |
| 5,063,947 | A | * | 11/1991 | Gueret | 132/218 |
| 5,161,554 | A | * | 11/1992 | Fitjer | 132/218 |
| 5,238,011 | A | * | 8/1993 | Gueret | 132/218 |
| 5,345,644 | A | * | 9/1994 | Gueret | 15/160 |
| 5,370,141 | A | | 12/1994 | Gueret | 132/218 |
| 5,380,592 | A | | 1/1995 | Tung | 428/397 |
| 5,657,778 | A | * | 8/1997 | Gueret | 132/320 |
| 5,709,230 | A | * | 1/1998 | Miraglia | 132/218 |
| 6,048,615 | A | | 4/2000 | Lin | 428/397 |
| 6,073,634 | A | * | 6/2000 | Gueret | 132/218 |
| 6,481,445 | B1 | * | 11/2002 | Miraglia | 132/218 |

FOREIGN PATENT DOCUMENTS

| | | |
|---|---|---|
| EP | 130 611 | 5/1989 |
| WO | WO 01/58309 | 8/2001 |

* cited by examiner

*Primary Examiner*—Mark Spisich
(74) *Attorney, Agent, or Firm*—St. Onge Steward Johnston & Reens LLC

(57) ABSTRACT

An improved mascara brush has a typical twisted wire core containing bristles having a high durometer and relatively large diameter. The bristle density is in the range of 8 to 20 bristles per turn; more preferably 10–15 bristles per turn, and most preferably 12–14 bristles per turn. The bristles have a diameter of from 0.010 inch to about 0.016 inch, preferably 0.011 inch to 0.014 inch, and most preferably 0.011 or 0.012 inch. The bristle durometer is in the range of about 92 Shore D hardness to 120 Rockwell R; more preferably about 100 to 120 Rockwell R; most preferably about 103 to 108 Rockwell R. In one preferred embodiment, the filaments have a durometer of 108 Rockwell R. The brush is stable and effective for rapid lengthening of eyelashes and combing of the eyelashes.

32 Claims, 1 Drawing Sheet

MASCARA BRUSH WITH HIGH DUROMETER FIBERS

FIELD OF THE INVENTION

The present invention relates to a brush for applying cosmetic products, in particular, mascara, to eyelashes.

BACKGROUND OF THE INVENTION

Twisted wire brushes for application of liquid-type cosmetics, such as for application of mascara to the eyelashes, are well known in the art. The brushes are designed to pick up and hold a supply of mascara from the cosmetic container, and then deliver the mascara to the eyelashes as the brush is combed through the lashes by the user.

Twisted wire brushes conventionally are manufactured by disposing a plurality of individual lengths of bristles transverse to and between substantially parallel, slightly spaced-apart thin metal wire lengths, such that the wire lengths generally bisect the filament lengths at their midpoints. Most typically, the parallel wire lengths comprise the two substantially equal leg lengths formed from bending a single length of wire into a U-shaped configuration. The wire lengths are then twisted together to form a helical core, causing the bristles disposed between the wires to be clamped therebetween at about their midpoints. In the twisting and clamping, the segments of the bristles on either side of the clamped midpoint are caused to flare radially outward from the core and so form an elongate bristle brush portion of generally circular cross-section. The brush is generally provided with a handle which can comprise, or be affixed to, a cap or other closure for the cosmetic container.

It is known in the art that this helical wire twisting method for forming cosmetic applicator brushes typically leads to a brush configuration in which the bristles tend generally to follow the helical pattern of the twisted wire core, i.e., whereby the tips of the bristles define a helix. The degree of axial spacing between turns of the helix varies depending on the number, type and thickness of bristles employed, the wire thickness employed, the number of helical twists used in forming the wire core, and other like factors. See, for example, U.S. Pat. No. 4,887,622% to Gueret, and U.S. Pat. No. 4,733,425 to Hartel et al.

The bristles are usually comprised of nylon filaments. The bristles serve the function of collecting mascara from a reservoir and holding the mascara until it is applied to the user's eyelashes. Standard mascara brush designs of the 1960s and 1970s used smaller diameter bristles in fairly large numbers of bristles per turn. At the time, it was believed that this provided superior performance in that the brush was fairly soft, and capable of a fairly high loading with mascara. Thus typical mascara brushes of this period had filaments having a diameter 0.005 inch (5 mil) or less and bristle counts of 50 bristles per turn (which means 100 bristle ends per turn of the helix).

The state of the art then evolved to a somewhat larger diameter bristle, as defined in U.S. Pat. No. 4,887,622 entitled "Brush for the Application of Mascara to the Eyelashes." The patent discloses a mascara brush having a reduced number of bristles, said to be 35% to 80% less than in conventional mascara brushes, ostensibly of larger diameter, than the bristles employed in conventional mascara brushes at the time. This was believed to provide a better application of mascara and separation of lashes. The patent specifies mascara brushes having a bristle diameter from about 0.10 to 0.25 mm (e.g. about 0.004 to 0.010 inch) (4 mil to 10 mil) and with from approximately 10 to 40 bristles per turn of the helix.

The concept of a mascara brush having larger diameter fibers was further discussed in a recent PCT application No. PCT/US01/04555. This application is directed towards mascara brushes made from filaments that are relatively large but soft. Specifically, the application describes mascara brushes having preferably having 7–14 bristles per turn. The bristle filaments are defined as preferably being from 0.010 inch to 0.013 inch (10 mil to 13 mil). Most critically, the bristles are defined as being relatively soft being made of a thermoplastic elastomer having a durometer of between 62 Shore D and 82 Shore D, but most preferably about 72 Shore D. PCT application PCT/US01/04555 essentially defines a mascara brush made with a duPont Filaments filament sold under the trademark "Supersoft." The "Supersoft" filaments have a durometer of 72 Shore D and are available as solid filaments or as triocular filaments having three hollow voids.

Mascara, which is typically highly viscous, tends to clump when applied to eyelashes. The clumps of mascara are typically combed out as a finishing step to the application process. Stiffer bristles are thought to be better suited for combing out clumps and properly separating lashes. However, the combing and separating functions are thought to be better accomplished with brushes a having relatively open bristle envelope or brush surface, i.e., an envelope or surface that has numerous or wide clearances or spaces between bristles to make the brushes more 'comb-like'. This function is not well served by traditional mascara brush designs having smaller diameter bristles with higher bristle density.

A mascara brush with softer, more numerous bristles has been generally thought to be well suited for applying mascara but less well suited for combing out clumps and separating lashes. Conversely, a brush with stiffer, fewer bristles has been thought to be well suited for combing and separating lashes but less well suited for applying mascara to lashes. While a separate brush can be used for each function, i.e., a soft brush for application and a stiff brush for combing, a single brush that can both apply mascara and comb out clumps would be preferred for the convenience of the user.

An example of a brush that is said to provide good application and combing characteristics is shown in U.S. Pat. No. 4,861,179 to Schrepf et al., which discloses a brush having a combination of conventional soft bristles and conventional stiff bristles.

Another example of a brush said to provide good application and combing characteristics is shown in U.S. Pat. No. 5,238,011 to Gueret. The Gueret patent discloses bristles made of a soft material having a shore hardness of 20A to 40D (as noted above, a conventional bristle typically has a durometer of over 85D), and a large diameter in a range of 0.004 inch to 0.014 inch (4 to 14 mil) (0.10 to 0.35 millimeter). As disclosed by Gueret, the diameter is said to be sufficiently large to prevent too high a degree of suppleness. The resulting brush is said to have the same degree of suppleness or softness as a conventional softer brush. Accordingly, the bristles are equivalent in stiffness to conventional bristles.

While the forgoing brushes may be suitable for the application and combing of mascara in use at the time, current mascara formulations have significantly higher viscosity, in the range of 2,000,000 centipoise and above. Higher viscosity mascaras tend to collapse softer durometer bristles, so they are not effective for their intended use.

Thus, there is a need for a brush that can apply mascara from a bottle to the user's eyelashes, uniformly and in desired amounts, and comb out any undesired excess while separating eyelashes, and which is suited for modern mascara formulations.

SUMMARY OF THE INVENTION

An improved mascara brush has a typical twisted wire core containing bristles having a high durometer and relatively large diameter. The bristle density is in the range of 8 to 20 bristles per turn; more preferably 10–15 bristles per turn, and most preferably 12–14 bristles per turn. The bristles have a diameter of from 0.010 inch to about 0.016 inch, preferably 0.011 inch to 0.014 inch, and most preferably 0.011 or 0.012 inch. The bristle durometer, determined by the durometer of the filaments from which the bristles are made, is in the range of about 92 Shore D hardness to 120 Rockwell R; most preferably about 100 to 120 Rockwell R; and in one preferred embodiment, the filaments have a durometer of 108 Rockwell R.

It is believed that the surprising and improved capabilities are due in part to the combined increase in diameter and durometer of each bristle, which yields a more stable overall brush form capable of better manipulating lashes to facilitate application and combing.

DETAILED DESCRIPTION OF THE DRAWINGS

Figure 1:
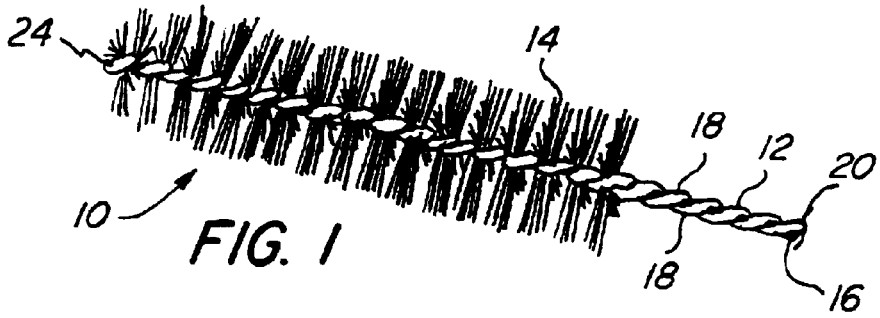
FIG. 1 is a side elevation view of a mascara brush in accordance with the invention.

Referring now to FIG. 1, a mascara applicator brush, designated generally by reference numeral 10, is shown. The brush is intended for use in a typical mascara bottle (not shown) with an opening into which the brush 10 is inserted.

The brush 10 is comprised of a central twisted wire core 12 containing bristles 14. The core 12 is a twisted wire core typically made by forming a soft metal wire 16 into a "U" shape. A plurality of bristles 14 are placed between the segments 18 of wire 16. The wire segments 18 are then twisted about the longitudinal axis to clamp bristles 14 at approximately a midpoints of the bristles 14. The bristle ends extend radially from the twisted wire core 12.

The bristle density is in the range of 8 to 20 bristles per turn; more preferably 10–15 bristles per turn, and most preferably 12–14 bristles per turn.

The number of bristles per turn can be determined by several methods. One method involves counting bristle ends in one 360 degree turn of the brush and dividing by two to arrive at a count of bristles per turn. Another method involves counting the total number of 360 degree turns of the bristles of the brush along the length of the brush, then counting the total number of bristles, and diving the total bristle count by the total turn count, to determine an average of bristles per turn. It is contemplated that in a basic brush, there will be a substantially constant bristle density along the length of the brush, with a small variations depending on manufacturing precision. However, it is also possible that the bristle densities are an average bristle density, with greater variation in the bristle density between different zones (such as the ends versus the middle zones of the brush).

Core 12 has a lower end 20 connected to a shaft, and an upper end 24 opposite the lower end 20. The lower end 20 of the core 12 is connected to a handle by way of the shaft, however, the lower end 20 of the core 12 could alternatively be attached to another structure such as a bottle cap.

After the bristles 14 are mounted to the wire core 12 the brush 10 can be trimmed to have any desired shape, for example, cylindrical, tapered, conical, curved, etc.

Bristles 14 are preferably made by cutting short segments from spools of filaments. The filaments are selected for having a specific hardness, specifically, a durometer in the range of about 92 Shore D hardness to 120 Rockwell R; more preferably about 100 to 120 Rockwell R; most preferably about 103 to 108 Rockwell R. In one preferred embodiment, the filaments have a durometer of 108 Rockwell R. Each of the bristles should have a diameter of from 0.010 inch to about 0.016 inch (10 mil to 16 mil). Preferably the diameter of the bristles will be 0.011 inch to 0.014 inch. As noted hereafter, the filaments may be round or may have non-circular cross-sectional shapes, thus, the term "diameter" as used herein is intended to mean the maximum distance between any of the possible opposite positions on the outer surface of a bristle filament.

In one preferred embodiment, the mascara brush 10 was made with Nylon 6–12 filament having a diameter of 0.011 inch (11 mil) and a durometer of 108 Rockwell R. The bristles 14 were mounted to the twisted wire core 12 at a density of 12 bristles per turn (24 bristle ends per turn). The resulting mascara brush 10 provided a quick and easy application of mascara to eyelashes, with immediate lengthening of the lashes, but also good combing and separation of the lashes.

In another preferred embodiment, the mascara brush 10 was again made with Nylon 6–12 filament having a diameter of 0.011 inch (11 mil) and a durometer of 108 Rockwell R. The bristles 14 were mounted to the twisted wire core 12 at a density of 13 bristles per turn (26 bristle ends per turn). This mascara brush had similar performance as the embodiment having 12 bristles per turn.

Figure 2:
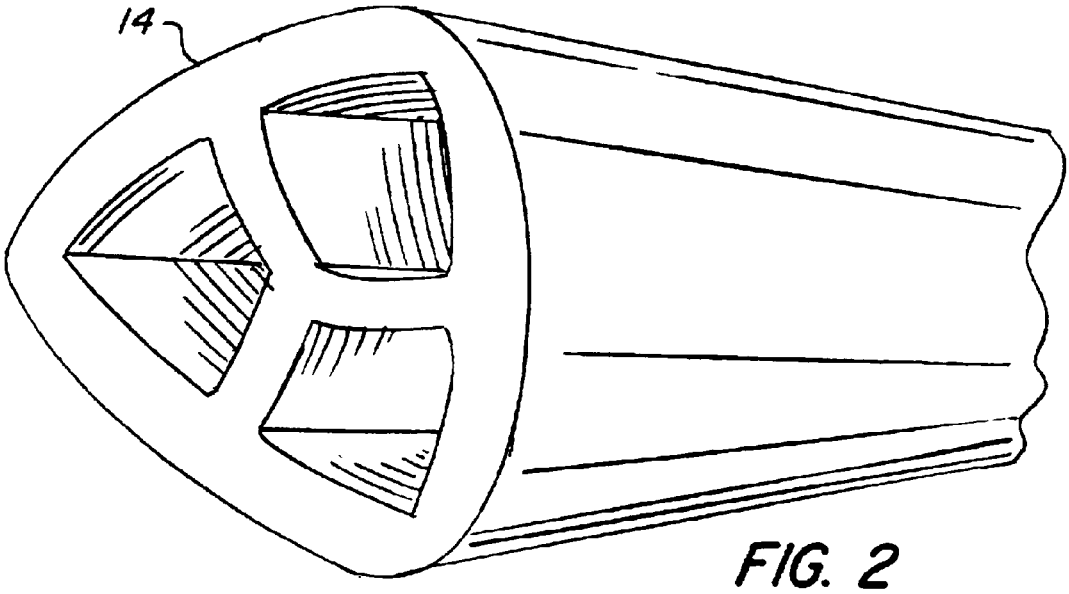
FIG. 2 is a cross-sectional view of a hollow bristle, made from a triocular filament having three longitudal hollow voids.

The bristles 14 (or the filament from which they are made) can be a solid shape in cross-section, or they may be hollow. Hollow cross-section bristles may have a single void or multiple, radially adjacent voids. Each void may extend through the cross-section continuously along the length of each fiber, or may be provided in the cross-section at spaced intervals along the length of each fiber. A void may open outwardly at the bristle tip, whereby through capillary action it will retain an additional quantity of mascara. The bristles 14 may be round in cross-section, or have other cross-sectional shapes, such as oval or triangular. In one embodiment, as shown in FIG. 2, the bristles 14 may be triocular, e.g. have three voids running the length of the bristle. Alternatively, the bristles 14 may be C-shaped or otherwise formed such as in the shape of the dupont "horseshoe" filament or have other shapes with structural details to increase the surface area of the bristle.

Figure 3:
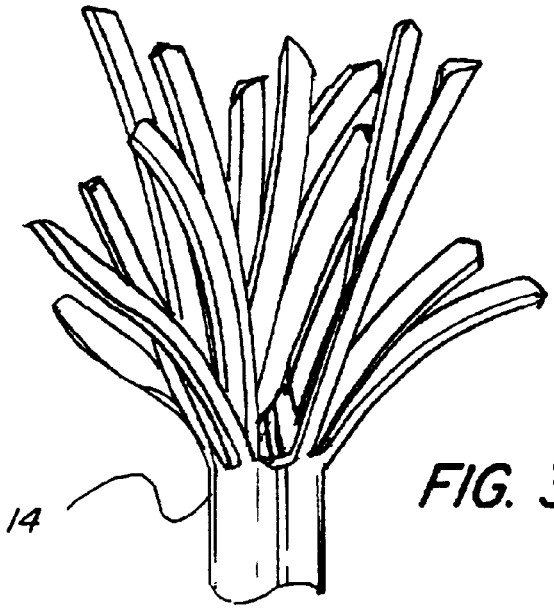
FIG. 3 is a side elevation view of a bristle end which has been split by a mechanical knife tool.

In addition, the bristle ends may be processed in a variety of ways. The bristle ends can be treated by grinding. In a preferred embodiment, the bristle ends are treated by slitting with sharp metal knife blades mounted on a rotating spindle. The flagged ends of the bristles, as shown in FIG. 3, provide enhanced mascara holding and application to eye lashes, along with a soft feel to the touch.

In combination, the larger diameter and the harder durometer of the bristle, used in a brush with fairly low bristle counts, yields a brush that is excellent in fast and effective application of mascara to the eyelashes, with good ability to lift and comb the lashes. The mascara brush of the invention provides uniform coating of mascara on eyelashes. Although useful with any conventional mascara, the improved brushes made with bristles according to the foregoing disclosure are particularly important when used with higher viscosity, faster setting mascara formulas. The larger, harder bristles provide a mascara brush capable of applying modern mascara formulas in sufficient volumes and combing out excess without the disadvantage of bristles collapsing. The brush obtains this result without resorting to the more costly mixed bristle brush designs of the prior art.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A brush for applying mascara to eyelashes, comprising:

a twisted wire core holding a plurality of radially extending bristles to form a brush at an end of the core, said bristles having a diameter of between about 0.010 inch to about 0.016 inch, and a durometer of about 92 Shore D to about 120 Rockwell R, said bristles being provided at a bristle density of between about 8 to about 20 bristles per turn.

2. A brush in accordance with claim 1, wherein the bristles have a durometer of about 103–108 Rockwell R.

3. A brush in accordance with claim 2, wherein the bristles have a durometer of about 108 Rockwell R.

4. A brush in accordance with claim 1, wherein the bristles have a diameter of about 0.011 inch to 0.014 inch.

5. A brush in accordance with claim 1, wherein the bristles have a diameter of about 0.011 inch or 0.012 inch.

6. A brush in accordance with claim 1, wherein said brush has a substantially constant bristle density of about 8 to about 20 bristles per turn.

7. A brush in accordance with claim 6, wherein said brush has a substantially constant bristle density of about 10 to about 15 bristles per turn.

8. A brush in accordance with claim 7, wherein said brush has a substantially constant bristle density of about 12 to about 14 bristles per turn.

9. A brush in accordance with claim 8, wherein said brush has a substantially constant bristle density of about 12 bristles per turn.

10. A brush in accordance with claim 8, wherein said brush has a substantially constant bristle density of about 13 bristles per turn.

11. A brush in accordance with claim 1, wherein on average along the length of the brush, there are between about 8 to about 20 bristles per turn.

12. A brush in accordance with claim 11, wherein on average along the length of the brush, there are between about 10 to about 15 bristles per turn.

13. A brush in accordance with claim 11, wherein on average along the length of the brush, there are between about 12 to about 14 bristles per turn.

14. A brush in accordance with claim 1, wherein said bristles are solid.

15. A brush in accordance with claim 1, wherein said bristles contain hollow voids.

16. A brush in accordance with claim 15, wherein tips of said bristles have been mechanically abraded, or split by a mechanical knife tool.

17. A brush in accordance with claim 1, wherein said bristles are made from triocular fibers having three longitudinal hollow voids.

18. A brush for applying mascara to eyelashes, comprising:

a twisted wire core holding a plurality of radially extending bristles to form a brush at an end of the core, said bristles having a diameter of between about 0.011 inch to about 0.014 inch, and a durometer of about 100 to about 120 Rockwell R, said bristles being provided at a bristle density of between about 10 to about 15 bristles per turn.

19. A brush in accordance with claim 18, wherein the bristles have a durometer of about 103 to about 108 Rockwell R.

20. A brush in accordance with claim 19, wherein the bristles have a diameter of about 0.011 inch.

21. A brush in accordance with claim 19, wherein the bristles have a diameter of about 0.012 inch.

22. A brush in accordance with claim 19, wherein said brush has a substantially constant bristle density of about 0 to about 15 bristles per turn.

23. A brush in accordance with claim 19, wherein said brush has a substantially constant bristle density of about 12 to about 14 bristles per turn.

24. A brush in accordance with claim 19, wherein said brush has a substantially constant bristle density of about 12 bristles per turn.

25. A brush in accordance with claim 19, wherein said brush has a substantially constant bristle density of about bristles per turn.

26. A brush in accordance with claim 19, wherein the bristles have a durometer of about 108 Rockwell R.

27. A brush in accordance with claim 19, wherein on average along the length of the brush, there are between about 10 to about 15 bristles per turn.

28. A brush in accordance with claim 19, wherein on average along the length k of the brush, there are between about 12 to about 14 bristles per turn.

29. A brush in accordance with claim 19, wherein said bristles are solid.

30. A brush in accordance with claim 19, wherein said bristles contain hollow voids.

31. A brush in accordance with claim 30, wherein said bristles are made from triocular fibers having three longitudinal hollow voids.

32. A brush in accordance with claim 30, wherein tips of said bristles have been split by a mechanical knife tool or mechanically abraded.

* * * * *